United States Patent [19]

Bartholic

[11] 4,311,580

[45] Jan. 19, 1982

[54] SELECTIVE VAPORIZATION PROCESS AND DYNAMIC CONTROL THEREOF

[75] Inventor: David B. Bartholic, Watchung, N.J.

[73] Assignee: Engelhard Minerals & Chemicals Corporation, Edison, N.J.

[21] Appl. No.: 144,477

[22] Filed: Apr. 28, 1980

Related U.S. Application Data

[63] Continuation-in-part of Ser. No. 90,247, Nov. 1, 1979, Pat. No. 4,263,128, and a continuation-in-part of Ser. No. 875,326, Feb. 6, 1978, abandoned.

[51] Int. Cl.[3] ..... C10G 25/08

[52] U.S. Cl. ..... 208/91; 208/93; 208/251 R; 208/DIG. 1

[58] Field of Search ..... 208/127, DIG. 1, 251 R, 208/370, 91, 93

[56] References Cited

U.S. PATENT DOCUMENTS

| | | | |
|---|---|---|---|
| 2,608,526 | 8/1952 | Rex | 208/127 |
| 2,874,092 | 2/1959 | Beuther | 208/127 |
| 3,074,878 | 1/1963 | Pappas | 208/127 |
| 3,324,030 | 6/1967 | Calabrese | 208/DIG. 1 |
| 3,513,087 | 5/1970 | Smith | 208/DIG. 1 |
| 3,629,097 | 12/1971 | Smith | 208/DIG. 1 |
| 4,093,537 | 6/1978 | Gross | 208/DIG. 1 |
| 4,263,128 | 4/1981 | Bartholic | 208/251 R |

*Primary Examiner*—T. M. Tufariello
*Attorney, Agent, or Firm*—Inez L. Moselle

[57] ABSTRACT

Whole crude and residual fractions from distillation of petroleum and like feed stocks are subjected to selective vaporization to prepare heavy fractions of reduced Conradson Carbon and/or metals content by short-term, high temperature riser contact with a substantially inert solid contact material of low surface area in a selective vaporization zone. High boiling point components of the charge which are of high Conradson Carbon number and/or high metal content remain on the contact material as a combustible deposit which is then burned off in a combustion zone whereby the contact material is heated to a high temperature for return to the selective vaporization zone to supply the heat required therein. The system is dynamically controlled for fuel supply in the combustion zone by the lower hydrogen content, least valuable components of the feed. That control is exercised by controlling the temperature of the selective vaporization zone to about the minimum value which will maintain a predetermined desired temperature in the combustion zone.

13 Claims, 2 Drawing Figures

SELECTIVE VAPORIZATION PROCESS AND DYNAMIC CONTROL THEREOF

CROSS REFERENCE TO RELATED APPLICATIONS

This application is a continuation-in-part of application Ser. No. 090,247, filed Nov. 1, 1979, now U.S. Pat. No. 4,263,128, as a continuation-in-part of application Ser. No. 875,326, filed Feb. 6, 1978, abandoned.

BACKGROUND OF THE INVENTION

The invention is concerned with increasing the portion of heavy petroleum crudes which can be utilized as catalytic cracking feed stock to produce premium petroleum products, particularly motor gasoline of high octane number, or as high quality heavy fuel. The heavy ends of many crudes are high in Conradson Carbon (sometimes reported as Ramsbottom Carbon) and metals which are undesirable in catalytic cracking feed stocks and in products such as heavy fuel. The present invention provides an economically attractive method for selectively removing and utilizing these undesirable components from whole crudes and from the residues of atmospheric and vacuum distillations, commonly called atmospheric and vacuum residua or "resids". The terms "residual stocks", "resids" and similar terminology will be used here in a somewhat broader sense than is usual to include any petroleum fraction remaining after fractional distillation to remove some more volatile components. In that sense "topped crude" remaining after distilling off gasoline and lighter is a resid. The undesirable CC (for Conradson Carbon) and metal bearing compounds present in the crude tend to be concentrated in the resids because most of them have low volatility. The terms "Conradson Carbon" and "Ramsbottom Carbon" have reference to the two most used tests for this undesirable constituent. Some difference in numerical values by the two tests may be found for the same sample, but generally the test results from either are indicative of the same characteristic.

When catalytic cracking was first introduced to the petroleum industry in the 1930's the process constituted a major advance in its advantages over the previous technique for increasing the yield of motor gasoline from petroleum to meet a fast growing demand for that premium product. The catalytic process produces abundant yields of high octane naphtha from petroleum fractions boiling above the gasoline range, upwards of about 400° F. Catalytic cracking has been greatly improved by intensive research and development efforts and plant capacity has expanded rapidly to a present day status in which the catalytic cracker is the dominant unit, the "workhorse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker are adversely affected.

Quality of heavy fuels such as Bunker Oil and heavy gas oil is also increasingly affected as it becomes necessary to prepare these from crudes of high CC, metals and salt contents.

The effect of higher Conradson Carbon in catalytic cracking is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, at least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottle-neck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. Excessive hydrogen also raises a bottle-neck problem. The lighter ends of the cracked product, butane and lighter, are processed through fractionation equipment to separate components of value greater than fuel to furnaces, primarily propane, butane and the olefins of like carbon number. Hydrogen, being incondensible in the "gas plant" occupies space as a gas in the compression and fractionation train and can easily overload the system when excessive amounts are produced by high metal content catalyst, causing reduction in charge rate to maintain the FCC Unit and auxiliaries operative.

In heavy fuels, used in stationary furnaces, turbines, marine and large stationary diesel engines, quality is a significant factor. For example, petroleum ash, particularly vanadium and sodium, attacks furnace refractories and turbine blades.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780°-840° F. During the long residence time at this temperature, the charge is converted to coke and distillate products taken off the top of the drum for recovery of "coker gasoline", "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for FCC charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts. It is often desirable to treat the gas oils by expensive hydrogenation techniques before charging to catalytic cracking or blending with other fractions for fuels. Coking does reduce metals and Conradson Carbon, but still leaves an inferior gas oil for charge to catalytic cracking.

Catalytic charge stock and fuel stocks may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked napththa. Low temperature, liquid phase sorption on catalytically inert silica gel is proposed by Shuman and Brace, Oil and Gas Journal, Apr. 6, 1953, page 113. See also U.S. Pat. Nos. 2,378,531, 2,462,891 and 2,472,723, cited in the said parent application Ser. No. 875,326, filed Feb. 6, 1978.

The above noted patents numbered U.S. Pat. Nos. 2,462,891 (Noll) and 2,378,531 (Becker) utilize a solid heat transfer medium to vaporize and preheat catalytic cracking charge stock utilizing heat from a catalytic regenerator. The intent of those patentees is to vaporize the total quantity of a catalytic charge stock, although it is recognized that a heavy portion of the charge may remain in liquid state and be converted to vaporized products of cracking and coke by prolonged contact with the heat transfer material, a conversion related to the coking processes earlier noted.

U.S. Pat. No. 2,472,723 proposes the addition of an adsorbtive clay to the charge for a catalytic cracking process. The clay is used on a "once-through" basis to adsorb the polynuclear aromatic compounds which are believed to be coke precursors and thus reduce the quantity of coke deposited on the active cracking catalyst also present in the cracking zone.

It is known to use solid heat transfer agents to induce extensive cracking of hydrocarbon charge stocks at the high temperatures and short reaction times which maximize ethylene and other olefins in the product. An example of such teachings is U.S. Pat. No. 3,074,878 to Pappas.

SUMMARY OF THE INVENTION

It is a primary objective of the invention to selectively remove high CC and high metal content components from a charge stock containing the highest boiling components of a crude (whole crude or a resid fraction) by a high temperature, short hydrocarbon residence time contact with a hot solid contact material which serves as a heat transfer medium and acceptor of unvaporized material in a selective vaporization zone. The solid contact material is essentially inert in the sense that it has low catalytic activity for inducing cracking of the charge stock and is preferably of very low surface area as compared with conventional cracking catalysts. The solid heat transfer material bearing the combustible deposit from the selective vaporization step is then subjected to a combustion step in a combustion zone to oxidize the combustible deposit and generate heat which is imparted to the solid contact material. The so heated contact material is then returned to the selective vaporization zone for contact with charge stock. By this technique, the heat required for selective vaporization is generated by combustion of the low hydrogen-content, low value components of the charge stock.

It is found that the nature of the selective vaporization is a function of temperature, total pressure, partial pressure of hydrocarbon vapors, residence time, charge stock and the like. One effect of temperature is a tendency to decrease the combustible deposit on the contact material as contact temperature is increased. Thus greater portions of the charge are vaporized at higher temperatures and the secondary effect of thermal cracking of deposited hydrocarbons increases at higher temperatures. These effects of higher temperature enhance the yield of product from the operation and reduce the fuel supplied to the combustion zone in the form of combustible deposit. According to the present invention, the selective vaporization zone is operated at about the minimum temperature which will maintain the combustion zone temperature at a desired predetermined temperature. That predetermined temperature of the combustion zone is preferably set at or near the maximum allowable temperature of the combustion zone, usually related to metalurgical limits of the burner.

By designating burner temperature as the master function, the dynamic control strategy of the invention provides for a slave control on temperature of the selective vaporization zone, the same being adjusted as may become necessary due to variations in feed stock and the like.

DESCRIPTION OF THE DRAWINGS

A system according to the invention for preparing charge stock to an FCC Unit is shown in FIG. 1 of the drawings.

DESCRIPTION OF THE PREFERRED EMBODIMENTS

Figure 1:
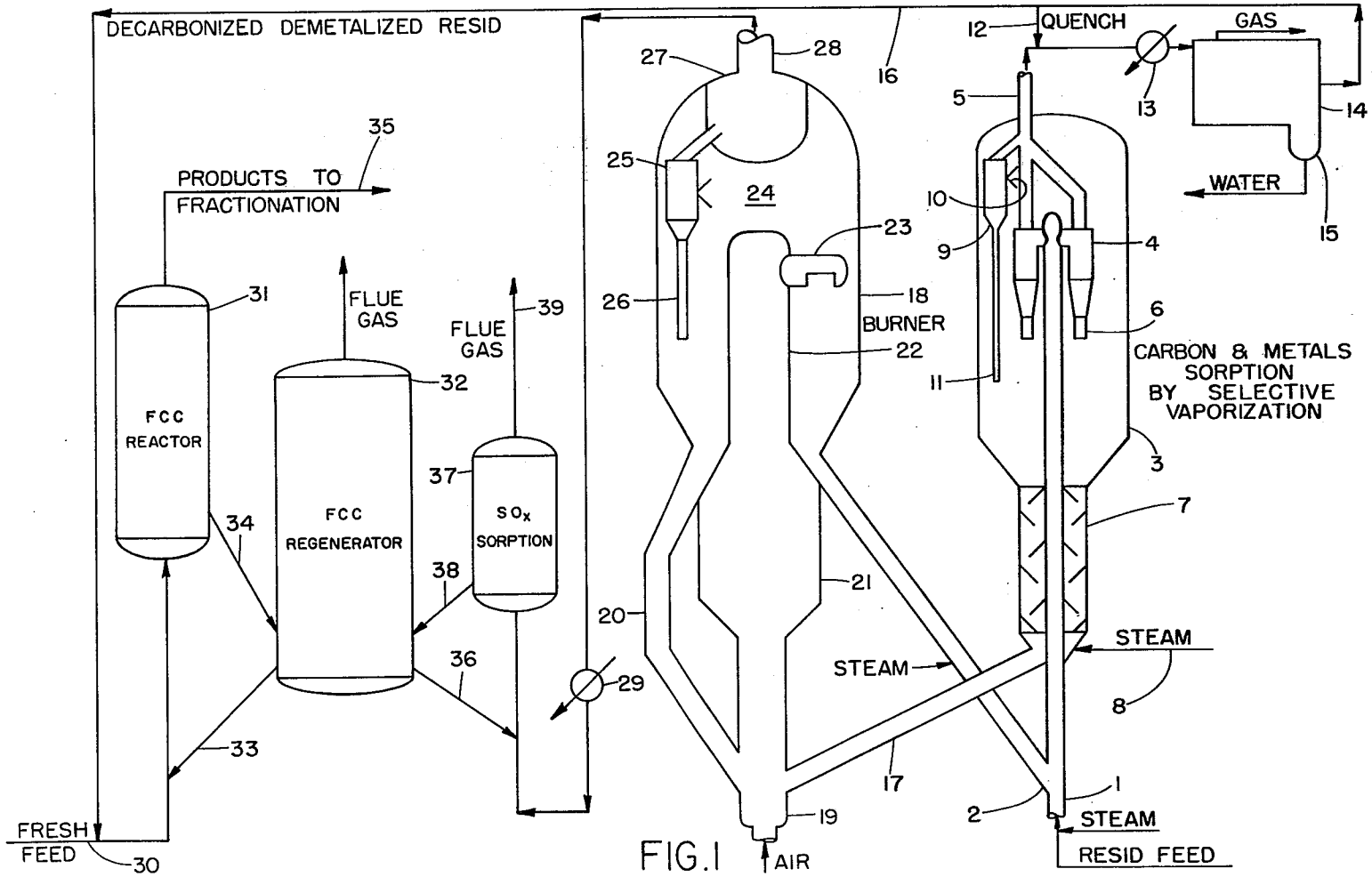

The selective vaporization step of the invention for decarbonizing and/or demetalizing of the charge stock is accomplished by contacting the crude or resid charge in a confined rising column with an inert solid of low surface area for very short hydrocarbon residence time at high temperature, separating vaporous hydrocarbons from the solid and quenching the hydrocarbon vapors below cracking temperature as rapidly as possible.

Because the process involves very rapid vaporization and little cracking, the conventional method for calculating residence time in superficially similar FCC riser reactors is not well suited to the process of the invention. FCC residence times assume a large increase in number of mols of vapor as cracking proceeds up the length of the riser. Such effects are minimal in the process of the invention. As used herein, hydrocarbon residence time is calculated as length of the riser from the charge introduction point to the point of separating solids from vapors divided by superficial linear velocity at the solids separation point, thus assuming that linear velocity is constant along the riser. The assumption is not believed to be strictly accurate but involves such minor deviations that the method of calculations is a highly useful measurement. As so measured, the hydrocarbon residence time will be less than 3 seconds when applying the invention to best advantage. Since some minor cracking, particularly of the deposit on the inert solid, will take place at the preferred temperatures for very heavy charge stocks, the operation is improved by the extent to which residence time can be reduced, often limited by characteristics of the equipment employed. Thus if the equipment permits, residence times less than two seconds are preferred, such as 0.5 second or less.

The necessary short residence time is conveniently achieved by supply of the solid in a size of about 20 to 150 microns particle diameter mixed with the resid charge in a riser. The oil is introduced at a temperature below thermal cracking temperature in admixture with steam and/or water to reduce partial pressure of volatile components of the charge. The catalytically inert solid is supplied to a rising column of charge at a temperature and in an amount such that the mixture is at a temperature upwards of 700° F. to 1050° F. and higher, e.g. 1250° F., sufficient to vaporize most of the charge.

As noted, the contact temperature will be high enough to vaporize most of the charge, above 900° F. for resids boiling above about 500° to 650° F. For stocks containing light ends, such as whole crudes and topped crudes, a contact temperature will be chosen above the average boiling point of the stock, as defined by Bland and Davidson, "Petroleum Processing Handbook" at page 14-4, that is, at a temperature above the sum of ASTM distillation temperatures from the 10 percent point to the 90 percent point, inclusive, divided by nine.

At the top of the riser the solid is rapidly separated from oil vapors and the latter are quenched to temperatures at which thermal cracking is essentially arrested. During the course of this very short contact, the heavy components of high Conradson Carbon value containing the majority of the metal content are laid down on the solid particles. This deposition may be a coalescing of liquid droplets, adsorption, condensation or some combination of these mechanisms. In any event, there appears to be little or no conversion of a chemical nature. Particularly, thermal cracking is minimal and is primarily restricted to the materials deposited on the solid. The quantity removed from the charge under preferred conditions is very nearly that indicated by Conradson Carbon of the resid charged. Further, the hydrogen content of the deposit on the solids is about 3% to 6%, below the 7-8% normal in FCC coke.

The solids, now bearing deposits of the high CC and metals components of the resid, are then contacted with air, in a burner, for example, by any of the techniques suited to regeneration of FCC catalyst, preferably under conditions of full CO combustion to less than 1000 ppm CO in the flue gas. Combustion of the deposited material from the inert solids generates the heat required in the contacting step when the inert solid is returned to the riser.

The decarbonizing, demetallizing step which characterizes the present invention is preferably conducted in a contactor very similar in construction and operation to the riser reactors employed in modern FCC Units. Typically, a resid feed, either a vacuum resid boiling above 900° F. or an atmospheric resid which may contain components boiling as low as 500° F., is introduced to the lower end of a vertical conduit. Volatile material such as light hydrocarbons recycled in the process, steam and/or water in amounts to substantially decrease hydrocarbon partial pressure is added with the feed stock. This introduction of light hydrocarbons, steam, water, etc. has an effect on temperature in the burner. The material so introduced uses part of the sensible heat of the inert solid for vaporization and/or heating to contact temperature, thus increasing the amount of inert required and decreasing the percent of combustible deposit on the inert solid for combustion in the burner, thereby reducing burner temperature. The converse is also true. Reduction in amounts of water, etc., or increase in partial pressure will tend to increase burner temperature. It will be recognized that, at constant feed rate, variations in amounts of water, etc. will affect hydrocarbon contact or residence time. Pressures will be sufficient to overcome pressure drops, say 15 to 50 psia. The charge may be preheated in a furnace, not shown, before introduction to the riser contactor, to any desired degree below thermal cracking temperature, e.g., 200°-800° F., preferably 300°-700° F. Higher temperatures will induce thermal cracking of the feed with production of low octane naphtha.

The feed diluted by light hydrocarbons, steam or the like, rises in the selective vaporization contactor 1 at high velocity such as 40 feet per second or more measured at the top of the vertical conduit. Hot inert solid in finely divided form is introduced to the feed from a standpipe 2 in a quantity and at a temperature to provide a mixture at a suitable elevated temperature to volatilize all components of the feed except the very heavy compounds of high CC and high metal content.

The solid contacting agent is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27 API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. Other suitable inert solids include coke from petroleum or coal and, in general, any solid which satisfies the stated criteria.

The microspheres of calcined kaolin clay preferably used in the process of the invention are known in the art and are employed as a chemical reactant with a sodium hydroxide solution in the manufacture of fluid zeolitic cracking catalysts as described in U.S. Pat. No. 3,647,718 to Haden et al. In practice of the instant invention, in contrast, the microspheres of calcined kaolin clay are not used as a chemical reactant. Thus the chemical composition of the microspheres of calcined clay used in practice of this invention corresponds to that of a dehydrated kaolin clay. Typically, the calcined microspheres analyze about 51% to 53% (wt.) $SiO_2$, 41 to 45% $Al_2O_3$, and from 0 to 1% $H_2O$, the balance being minor amounts of indigenous impurities, notably iron, titanium and alkaline earth metals. Generally, iron content (expressed as $Fe_2O_3$) is about $\frac{1}{2}$% by weight and titanium (expressed as $TiO_2$) is approximately 2%.

The microspheres are preferably produced by spray drying an aqueous suspension of kaolin clay. The term "kaolin clay" as used herein embraces clays, the predominating mineral constituent of which kaolinite, halloysite, nacrite, dickite, anauxite and mixtures thereof. Preferably a fine particle size plastic hydrated clay, i.e., a clay containing a substantial amount of submicron size particles, is used in order to produce microspheres having adequate mechanical strength.

To facilitate spray drying, the powdered hydrated clay is preferably dispersed in water in the presence of a deflocculating agent exemplified by sodium silicate or a sodium condensed phosphate salt such as tetrasodium pyrophosphate. By employing a deflocculating agent, spray drying may be carried out at higher solids levels and harder products are usually obtained. When a deflocculating agent is employed, slurries containing about 55 to 60% solids may be prepared and these high solids slurries are preferred to the 40 to 50% slurries which do not contain a deflocculating agent.

Several procedures can be followed in mixing the ingredients to form the slurry. One procedure, by way of example, is to dry blend the finely divided solids, add the water and then incorporate the deflocculating agent. The components can be mechanically worked together or individually to produce slurries of desired viscosity characteristics.

Spray dryers with countercurrent, cocurrent or mixed countercurrent and cocurrent flow of slurry and hot air can be employed to produce the microspheres. The air may be heated electrically or by other indirect means. Combustion gases obtained by burning hydrocarbon fuel in air can be used.

Using a cocurrent dryer, air inlet temperatures to 1200° F. may be used when the clay feed is charged at a rate sufficient to produce an air outlet temperature within the range of 250° F. to 600° F. At these temperatures, free moisture is removed from the slurry without removing water of hydration (water of crystallization) from the raw clay ingredient. Dehydration of some or all of the raw clay during spray drying is contemplated. The spray dryer discharge may be fractionated to recover microspheres of desired particle size. Typically particles having a diameter in the range of 20 to 150 microns are preferably recovered for calcination. The calcination may be conducted in the manufacturing operation or by adding the spray dried particles to the burner described below.

While it is preferable in some cases to calcine the microspheres at temperatures in the range of about 1600° F. to 2100° F. in order to produce particles of maximum hardness, it is possible to dehydrate the microspheres by calcination at lower temperatures; for example, temperatures in the range of 1000° F. to 1600° F., thereby converting the clay into the material known as "metakaolin". After calcination the microspheres should be cooled and fractionated, if necessary, to recover the portion which is in desired size range.

Pore volume of the microspheres will vary slightly with the calcination temperature and duration of calcination. Pore size distribution analysis of a representative sample obtained with a Desorpta analyzer using nitrogen desorption indicates that most of the pores have diameters in the range of 150 to 600 Angstrom units.

The surface area of the calcined microspheres is usually within the range of 10 to 15 $m^2/g$. as measured by the well-known B.E.T. method using nitrogen absorption. It is noted that the surface areas of commercial fluid zeolitic catalysts is considerably higher, generally exceeding values of 100 $m^2/g$. as measured by the B.E.T. method.

Other solids of low catalytic activity and of like particle size may be employed, e.g. coke as described above. In general, solids of low cost are recommended since it may be desirable to discard a sizeable portion of the contact agent in the system from time to time and replace it with fresh agent to maintain a suitable level of metals. Since the solid is preferably of low porosity, resulting in deposition primarily on external surfaces, the invention contemplates abrading the particles as in a column of air at velocity to permit refluxing of solids for removal of external metal deposits.

Length of the riser contactor 1 is such as to provide a very short time of contact (hydrocarbon residence time) between the feed and the contacting agent as discussed above. The contact time should be long enough to provide good uniformity of contact between feed and contacting agent, say at least 0.1 second.

At the top of the riser, e.g., 15 to 20 feet above the point of introduction of contacting agent from standpipe 2 at a feed velocity of 40 feet per second, vaporized hydrocarbons are separated as rapidly as possible from particulate solids bearing the high CC deposits and metals, if any. This may be accomplished by discharge from the riser into a large disengaging zone defined by vessel 3. However, it is preferred that the riser vapors discharge directly into cyclone separators 4 from which vapors are transferred to vapor line 5 while entrained solids drop into the disengaging zone by diplegs 6 to stripper 7 where steam admitted by line 8 evaporates traces of volatile hydrocarbons from the solids. The mixture of steam and hydrocarbons, together with entrained solids enters cyclone 9 by mouth 10 to disengage the suspended solids for return to stripper 7 by dipleg 11. As well known in the FLuid Cracking art, there may be a plurality of cyclones 4 and cyclones 9 and the cyclones may be multi-stage, with gas phase from a first stage cyclone discharging to a second stage cyclone.

A preferred technique for separating vapors from solids is by use of the vented riser described in Meyers, et al. U.S. Pat. Nos. 4,066,533 and 4,070,159. That apparatus and process effect substantial separation of vapor from solids at the top of the riser.

In one embodiment, the cyclones 4 may be of the stripper cyclone type described in U.S. Pat. No. 4,043,899, the entire disclosure of which is hereby incorporated by this reference. In such case, the stripping steam admitted to the cyclone may be at a low temperature, say 400° to 500° F., and serve to perform part or all of the quenching function presently to be described.

The vaporized hydrocarbons from cyclones 4 and 10 passing by way of line 15 are then mixed with cold hydrocarbon liquid introduced by line 12 to quench thermal cracking. The quenched product is cooled in condenser 13 and passed to accumulator 14 from which gases are removed for fuel and water, if any, is taken from sump 15, preferably for recycle to the contactor for generation of steam to be used as an aid in vaporizing charge at the bottom of the riser and/or removing heat from the burner. Condenser 13 is advantageously set up as a heat exchanger to preheat charge to the contactor or preheat charge to the FCC Unit hereinafter described and the like.

In one embodiment, the quenching is advantageously conducted in a column equipped with vapor-liquid contact zones such as disc and doughnut trays and valve trays. Bottoms from such column quencher could go directly to catalytic cracking with overhead passing to condenser 13 and accumulator 14 or to line 8 at the bottom of contactor 1.

Certain advantages can be realized in the system by using recycled light hydrocarbons at the bottom of riser-contactor 1 for vapor pressure reduction. It will be apparent that recycle of water from accumulator 14 for that purpose requires that the effluent of the contactor be cooled to the point of condensation of water, which in this water vapor/hydrocarbon vapor system is about 150° F. When hydrocarbons are used for vapor pressure reduction and as the stripping medium at line 8, condensation becomes unnecessary and the quenched riser effluent (less the amount recycled for vapor pressure reduction and/or stripping) may be passed directly to a catalytic cracking reactor. In such case, the riser contactor functions as the cat cracker preheat furnace.

When water is introduced for vapor pressure reduction, it is advantageously emulsified as the internal phase with the charge stock. When such emulsions are used, the water vaporizes with explosive force in contactor 1 to aid in dispersion of the oil.

Advantage from hydrocarbon recycle is realized when charging whole crude or topped crude to the riser-contactor 1 and passing the effluent to a fractionating column. In such case, the riser-contactor functions as a crude furnace to preheat charge for the crude distillation stage in addition to removing salts, metals and Conradson Carbon. Fractions from the crude still will include hydrocarbons for recycle, naphtha, gasoline, kerosene, gas oil, and a heavy bottom for fuel, FCC charge or the like.

The light hydrocarbons, preferably recycled in the process, will be chosen to boil below the contacting temperature of riser 1. Those light hydrocarbons may be the gas fraction derived from the process or like hydrocarbon gas from other source. Alternatively, the hydrocarbons used to aid in vaporization of the charge may be naphtha, kerosene, gas oil. These may come from external sources, but preferably are derived by recycle in the process.

The liquid hydrocarbon phase from accumulator 14 may be a desalted, decarbonized and demetallized resid fraction which is now satisfactory charge for catalytic cracking. This product of contact in riser 1 may be used in part as the quench liquid at line 12. The balance is preferably transferred directly to a catalytic cracker by line 16.

Returning now to stripper 7, the inert solid particles bearing a deposit of high CC and metallic compounds passes by a standpipe 17 to the inlet of burner 18. Standpipe 17 discharges to a riser inlet 19 of burner 18 where it meets a rising column of air introduced by line 19 and is mixed with hot inert particles from burner recycle 20 whereby the mixture is rapidly raised to a temperature for combustion of the deposits from treating resid, 1200°-1500° F. The mixture enters an enlarged zone 21 to form a small fluidized bed for thorough mixing and initial burning of deposits. The flowing stream of air carries the burning mass through a restricted riser 22 to discharge at 23 into an enlarged disengaging zone. The hot, burner particles, now largely free of combustible deposit fall to the bottom of the disengaging zone from which a part enters recycle 20 and another part enters the standpipe 2 for supply to contactor 1 after steam stripping. By reason of the very high temperatures attainable in this type of burner and in the presence of a stoichiometric excess of oxygen, CO will burn to provide a flue gas containing very little of that gas. In other types of burners, the combustion products may contain substantial amounts of CO which can be burned for its heating value in CO boilers of the type commonly used in FCC Units.

In the type of burner shown, the gaseous products of combustion, containing carbon dioxide, some residual oxygen, nitrogen, oxides of sulfur and perhaps a trace of CO, enter a cyclone 25 (one of a plurality of such devices) to disengage entrained solids for discharge by dipleg 26. The clarified gases pass to a plenum 27 from which flue gas is removed by outlet 28.

Although the system just described bears superficial resemblance to an FCC Unit, its operation is very different from FCC. Most importantly, the riser contactor 1 is operated to remove from the charge an amount not greatly in excess of the Conradson Carbon number of the feed. This contrasts with normal FCC "conversion" of 50-70%, measured as the percentage of FCC product not boiling within the range of the charge. Percent removed by the present process is preferably on the order of 10% to 20% on charge and constituted by gas, and deposit on the solid contacting agent. Rarely will the amount removed as gas, gasoline and deposit on the inert solid exceed a value, by weight, more than 3 to 4 times the Conradson Carbon value of the charge. This result is achieved by a very low severity of cracking due to inert character of the solid and the very short residence time at cracking temperature. As is well known, cracking severity is a function of time and temperature. Increased temperature may be compensated by reduced residence time, and vice versa.

The new process affords a control aspect not available to FCC Units in the supply of hydrocarbons or steam to the riser contactor. When processing stocks of high CC, the burner temperature will tend to rise because of increased supply of fuel to the burner. This may be compensated by increased quantity, decreased temperature, or increasing the hydrocarbons or steam supplied to reduce partial pressure of hydrocarbons in the riser contactor or recycling water from the overhead receiver to be vaporized in the riser to produce steam.

The riser contact with inert solid thus provides a novel sorption technique for removing the polynuclear aromatic compounds of resids (high CC and metals) while these are carried in a stream of low hydrocarbon partial pressure by reason of hydrocarbons or steam supplied to the riser.

The decarbonized, desalted and/or demetallized resid is good quality FCC charge stock and is transferred by line 16 to feed line 30 of an FCC reactor 31 operated in the conventional manner. Hot, regenerated catalyst is transferred from FCC regenerator 32 by standpipe 33 for addition to the reactor charge. Spend catalyst from reactor 31 passes by standpipe 34 to the regenerator 32, while cracked products leave reactor 31 by transfer line 35 to fractionation for recovery of gasoline and other conversion products.

Many residual fractions are high in sulfur content, particularly in the heavy components. The sulfur is oxidized to sulfur oxides ($SO_x$) in the burner 18 and these undesirable gases form part of the flue gas discharged at 28. In a preferred embodiment of the invention, the FCC Unit operates on a catalyst designed for reduction of $SO_x$ emissions. Several such catalysts are known in the art. Such catalysts will absorb $SO_x$ in the oxidizing environment of the regenerator. Catalyst which contains sorbed sulfur is then transferred to the reducing atmosphere of the reactor. In that reducing atmosphere and in the presence of water, the sulfur is converted to hydrogen sulfide, readily removed from reactor products in the usual gas plant and treating facilities of a refinery. See Belgian Pat. Nos. 849,635, 849,636 and 849,637.

As shown in the drawing, a drag stream of catalyst from regenerator 32 is passed by standpipe 36 to mix with cooled flue gas passed from burner 18 through heat exchanger 29. The mixture is then transferred to a fluidized bed contactor 37 resulting in sorption of $SO_x$ from the flue gas of burner 18. Catalyst carrying sorbed (reacted) $SO_x$ is conveyed by standpipe 38 back to regenerator 32 for ultimate reaction in reactor 31. After cyclonic separation of entrained catalyst, flue gas from which $SO_x$ has been so removed is then discharged by line 39 for recovery of the heat energy contained therein as by expansion turbines driving air blowers for regenerator 32 and burner 18; by waste heat boilers or the like.

The similarity of the equipment suited for use in the invention to that for practice of the FCC Process has been noted above and will be apparent from inspection of the vessels and connecting piping in FIG. 1. A further similarity is that the burner 18 and riser contactor 1 for this invention are preferably operated in the heat balanced mode practiced with modern FCC Units. This is accomplished by a valve in the hot contact material standpipe 2 controlled responsive to temperature in the selective vaporization zone, not shown in FIG. 1, but shown in FIG. 2, shortly to be described.

Despite the apparatus similarities to FCC, the present invention is characterized by process differences which differ drastically from FCC operation. The objective in FCC is to convert a heavy distillate fraction, a gas oil, to other products, primarily gasoline. Therefore the efficacy of an FCC Unit is reported as "conversion", measured as the percent of the charge stock which is converted to gas, gasoline and coke. FCC conversion levels are generally well in excess of 50%, ranging up to about 85%. By contrast, the present process seeks a maximum yield of product boiling in the same range as the charge stock but improved with respect to metals and CC content. The "yield" sought by the present invention is the converse of "conversion" in FCC. Yields obtained by the present process at the best conditions (shortest residence time) obtainable in available equipment have been around 70–75%, corresponding to 25–30% conversion when calculated by the method employed for FCC. As temperature of contact is raised, cracking increases to the detriment of yield. Yields as low as 45% have been seen at temperatures above 1000° F., corresponding to 55% "conversion", a value probably capable of favorable change at shorter residence times not feasible in equipment presently available.

Control of temperature in this process is a significant factor in achieving best results. In FCC, it is desirable to operate at the highest reactor temperature consistent with equipment limitations and other constraints in order to produce gasoline of maximum research octane number. In the present selective vaporization process, the lower temperatures of the operative range are more favorable. The temperature of the selective vaporization zone should be the minimum temperature which will sustain the heat balance relationship with the burner. As the temperature of the selective vaporization zone is decreased, less of the charge is vaporized and more is deposited on the inert solid material, thus furnishing a greater amount of fuel for the burner and tending to raise burner temperature. As the amount of such fuel approaches the level at which permissible burner temperatures are exceeded, the system reaches the minimum selective vaporization temperature-the preferred mode of operation. In general, selective vaporization temperatures of not more than about 1000° F. are preferred.

By contrast, it should be noted that the effect of reactor temperature in FCC is the opposite of that stated for the present process. Reduced FCC reactor temperature reduces the conversion level, resulting in lower coke make and reduced fuel for the regenerator.

The two processes also differ in considerations which determine contact time. In FCC, contact time required is related to catalyst activity. In selective vaporization, contact time should be the minimum attainable in the equipment used. The processes also differ in hydrogen transfer effects. In FCC, the bottoms (cycle oil and slurry oil) are very poor in hydrogen, which has transferred to gasoline and lighter products. In selective vaporization, the liquid product approximates the charge in hydrogen content, reflected in the crackability factor K as determined by U.O.P. Method 375–59. Products of this invention usually have a slightly lower K value than the charge, but under preferred conditions, a yield of higher K value than charge has been observed. FCC bottoms and cycle oils generally show drastically reduced K values as compared with charge.

Figure 2:
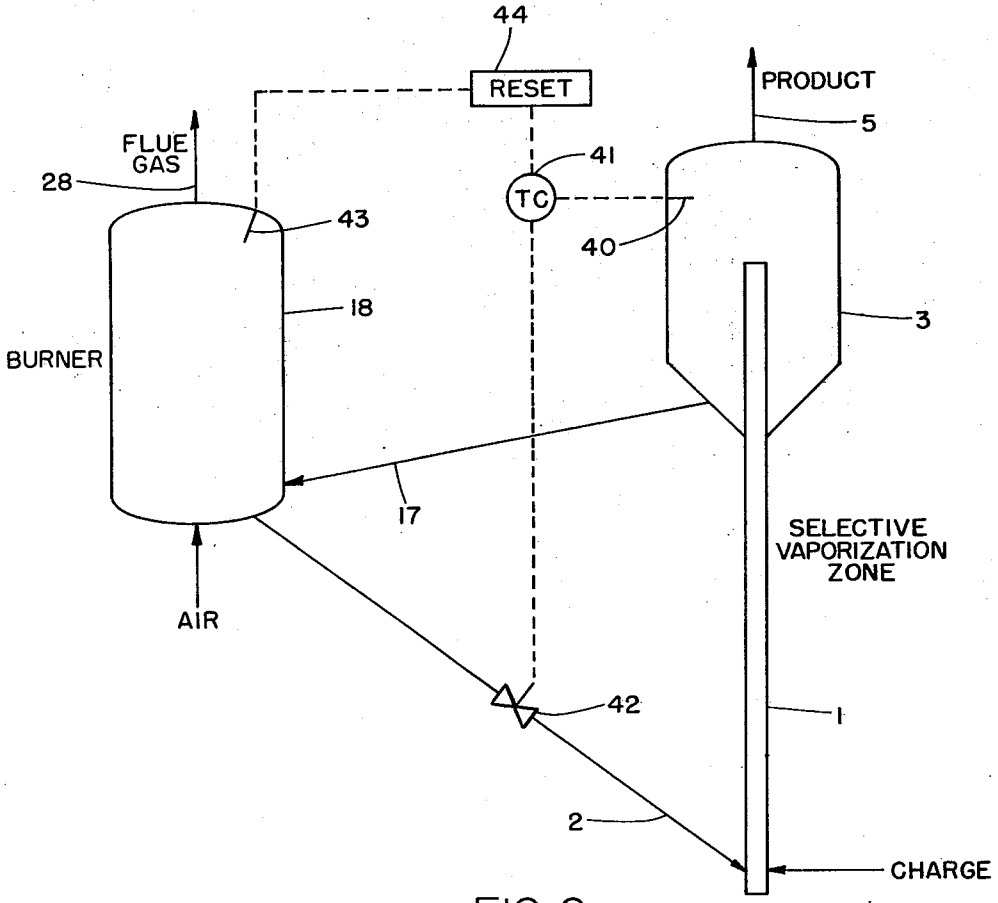
FIG. 2 is a diagrammatic representation of the dynamic control system utilized according to the invention.

Turning now to FIG. 2, a control system for application of the minimum vaporization temperature is shown diagrammatically. Temperature in the selective vaporization zone is sensed, as by thermocouple 40 and the resultant signal is applied to temperature controller (TC) 41 which activates a valve 42 in the hot solids standpipe 2 by which hot solids are returned from burner 18 to riser 1. Thus the rate of hot solids supply to the riser is regulated to hold constant the temperature in the selective vaporization zone. Such controls on the rate of hot solids supply to the riser are well known in FCC practice, where they constitute the master control of the FCC system.

In the present selective vaporization process, it is desired that the temperature set for the selective vaporization zone shall be the minimum value which will sustain heat balanced operation within limits of the burner, generally the maximum temperature permitted by burner metallurgy. For that purpose, a predetermined burner temperature is set. The temperature of the burner is sensed, as by thermocouple 43 and the signal so obtained is used for reset of temperature controller 41. Reset of temperature controller 41 may be manual or automatic as by reset instrumentation 44. In either system, a tendency to higher temperature is adjusted by raising the set point of controller 41 until the heat balanced system of riser contactor 1 and burner 18 stabilize at the predetermined burner temperature. Conversely, a trend to lower temperature in burner 18 is countered by reduction of the contactor set point in temperature controller 41.

Aside from being the master control of a heat balanced system, the burner may be similar in structure and function to any of the many variants developed for FCC regenerator. The burner may be of the riser type with hot recycle shown in FIG. 1 or may be of the older, dense fluidized bed type and may include any of the known expedients for adjusting burner temperature such as nozzles for burning torch oil in the burner to raise temperature or heat exchangers for temperature reduction.

In preferred embodiments, the burner temperature is set at the maximum value which can be achieved without risk of heat damage to the burner metallurgy or the circulated inert solid, say 1350° F. or higher, such as 1500° F. To this end, the burner is designed for maximum combustion of carbon in the deposit to carbon dioxide by burning carbon monoxide initially formed. The essentially complete combustion of carbon monoxide may be achieved by burner structure or by provision of oxidation catalysts in the burner zone. The burner of FIG. 1 is one known structure for the purpose. Another system involves injection of the solids into a dilute phase above a dense bed in the burner to pick up heat from "after burning" above the dense bed.

In any of the systems for combustion of carbon monoxide, the burner is operated with an excess of air to promote carbon monoxide conversion. That reaction can be promoted by oxidation catalysts such as Group VIII metals and certain other metals and metal compounds, e.g., vanadium, chromium, manganese, tungsten, etc. In use the inert solids of this invention acquire deposits of metals, primarily nickel and vanadium which can function as oxidation catalysts. Surprisingly, the process tolerates fairly high levels of such metals without intolerable dehydrogenation side effects in the selective vaporization zone, upwards of 1.5 wt. % metal on the circulating inert solid. If desired that effect can be enhanced by metal or metal compounds deposited on the circulating solid before introduction to the system. For example, a small amount of such precious metals as platinum and palladium may be applied to the inert solid particles.

EXAMPLES

The effect of contacting in the manner described above has been demonstrated in laboratory scale equipment. The apparatus employed is a circulating fluidized bed pilot plant which simulates behavior of commercial FCC riser reactors. The reactor is equipped to provide a stream of nitrogen through the riser and for addition of catalyst and charge. The riser is lagged and heated to maintain isothermal conditions. The nitrogen flow serves the same function as the hydrocarbons or steam described above for reduction in partial pressure of hydrocarbons. In the runs described below residual stocks and the microspheres set forth above were contacted under the conditions recited. Inspection data on the charge stock are given in Table I.

DESCRIPTION OF CHARGE STOCKS

| Example | 1 | 2 |
|---|---|---|
| Gravity, °API | 27.9 | 23 |
| Ramsbottom Carbon, % | 0.35 | 2.5 |
| Metals, ppm | | |
| Ni | 1 | 10 |
| Cu | 1 | 1 |
| V | 1 | 20 |
| Distillation, °F. | | |
| IBP | 438 | 420 |
| 10% | 554 | 478 |
| 30 | 659 | 711 |
| 50 | 750 | 829 |
| 70 | 847 | 979 |
| 76 | — | 1046 |
| 90 | 991 | — |
| 94 | 1050 | — |

Conditions of contact and resultant products are shown in Table II.

| Example | 1 | 2 |
|---|---|---|
| Riser contactor temp., °F. | 930 | 930 |
| Contact time, seconds | 0.66 | 0.97 |
| Contact solid temp., °F. | 1200 | 1200 |
| Oil partial pressure, psia | 2.83 | 4.62 |
| Oil preheat temp., °F. | 640 | 655 |
| Solids/oil, wt. | 12.5 | 12.2 |
| Mol ratio, $N_2$/oil | 3.7 | 2.2 |
| Products, wt. % | | |
| Gas | 7.9 | 7.6 |
| Liquid | 90.4 | 85.5 |
| Deposit on solid | 1.7 | 6.9 |
| Liquid Product | | |
| Metals, ppm | | |
| Ni | — | 1.5 |
| Cu | — | 1.0 |
| V | — | 1.0 |
| Ramsbottom Carbon | — | 0.6 |
| Distillation, °F. | | |
| IBP | 170 | 173 |
| 10% | 466 | 475 |
| 30 | 597 | 610 |
| 50 | 684 | 704 |
| 70 | 775 | 803 |
| 90 | 894 | 967 |
| 93 | — | 1033 |
| EP | 1028 | — |

Of particular interest is the observation that the gas fraction obtained in the above examples contains a substantial quantity of propane having premium value as liquified petroleum gas (LPG), together with propylene and butylenes valuable as alkylation feed and chemical raw material.

An interesting comparison can be made between the process of this invention and the process most used at the present time for removal of metals from heavy petroleum fractions. Catalytic hydrotreating typically reduces metal content by about 70%. Such hydrotreating is a mixed phase operation. It can be reasonably assumed that the residual metal in the product is primarily in constituents which remain in liquid phase during catalytic hydrotreating. In the present process, the only components of the product are those which vaporize in the selective vaporization zone. This characteristic of the process is reflected in the very low metal content of the product as shown in Table II.

It has been noticed that there may be maximum yield (minimum conversion) for each feedstock. In other words, lowering the temperature of the selective vaporization zone below a certain point characteristic of the charge will not affect the percent yield of product boiling in the range of the charge. It will, however, improve the crackability of the product.

I claim:

1. In a process for decarbonizing or demetallizing a hydrocarbon charge of whole crude or a residual fraction thereof by contacting said charge in a confined rising vertical column with a finely divided solid contact material consisting essentially of an inert solid material having a microactivity for catalytic cracking not substantially greater than 20 at low severity, including a temperature of at least about 900° F. for a period of time less than about 3 seconds and less than that which induces substantial thermal cracking in said charge, at the end of said period of time separating a selectively vaporized major portion of said charge from said contact material bearing the unvaporized portion of the charge as deposit thereon, contacting said contact material bearing said deposit in a combustion zone with oxidizing gas to burn said deposit and generate heat whereby the temperature of said contact material is elevated by combustion of said unvaporized portion of the charge as fuel for the process, recycling the so heated contact material to renewed contact with said hydrocarbon charge, the improvement which comprises sensing the temperature of said confined column, regulating the rate of recycling said so heated contact material responsive to the temperature so sensed to maintain said sensed confined column temperature at a predetermined value and dynamically controlling the system for the purpose of utilizing low hydrogen content, low value portions of said charge as said fuel for the process which dynamic control comprises adjusting said predetermined value of said sensed confined column temperature to about the minimum level at which said deposit provides the quantity of fuel which will, on combustion, maintain said combustion zone at a predetermined temperature; said adjustment being effected (a) by reducing said predetermined temperature of said rising confined column to provide more fuel in order to correct a trend toward lower temperature in said combustion zone or (b) by increasing said predetermined temperature of said rising confined column to provide less fuel in order to correct a trend toward higher temperature in said combustion zone.

2. A process according to claim 1 wherein said dynamic control includes the steps of sensing the temperature in said combustion zone and resetting said predetermined temperature of said rising confined column as needed to achieve said minimum level.

3. A process according to claim 1 wherein the quantity of said vaporized major portion is less than said hydrocarbon charge by a weight percent no greater than twice the Conradson Carbon number of said hydrocarbon charge.

4. A process according to claim 1 wherein said inert solid contact material is introduced to said selective vaporization zone at a temperature substantially above the temperature of said hydrocarbon charge.

5. A process according to claim 1 wherein said inert solid contact material is calcined clay.

6. A process according to claim 1 wherein said period of time is less than about 0.5 seconds.

7. A process according to claim 1 wherein said inert solid contact material is a porous solid having a low surface area below 100 square meters per gram.

8. A process according to claim 1 wherein said inert solids contact material is a porous solid having a low surface area between about 10 and about 15 square meters per gram.

9. A process according to claim 1 wherein said inert solid contact material is calcined kaolin.

10. A process according to claim 1 wherein said inert solid contact material is a porous solid in which most of the pores have diameters of 150 to 600 Angstrom Units.

11. A process according to claim 1 wherein hydrocarbons, steam or water is added to said hydrocarbon charge for contacting with said inert solid contact material in an amount to substantially decrease hydrocarbon partial pressure.

12. A process according to claim 1 wherein said selectively vaporized major portion of said charge is quenched to a temperature below that which induces thermal cracking thereof promptly after separation from said contact material.

13. A process according to claim 1 wherein the residence time of said charge in contact with said inert solid contact material in said confined rising column is calculated as the length of said column from point of introduction of said charge to the point of separation divided by the superficial velocity of vapors at the top of said column.

* * * * *